US008715115B2

(12) United States Patent
Storey, III

(10) Patent No.: US 8,715,115 B2
(45) Date of Patent: May 6, 2014

(54) DISC HOOPS GAME AND APPARATUS

(76) Inventor: Lawrence B. Storey, III, Vicksburg, MS (US)

( * ) Notice: Subject to any disclaimer, the term of this patent is extended or adjusted under 35 U.S.C. 154(b) by 127 days.

(21) Appl. No.: 13/405,043

(22) Filed: Feb. 24, 2012

(65) Prior Publication Data

US 2012/0231902 A1 Sep. 13, 2012

Related U.S. Application Data

(60) Provisional application No. 61/450,787, filed on Mar. 9, 2011.

(51) Int. Cl.
*A63B 69/00* (2006.01)
*A63B 63/08* (2006.01)
*A63B 63/00* (2006.01)

(52) U.S. Cl.
CPC ..... *A63B 63/08* (2013.01); *A63B 63/083* (2013.01); *A63B 69/0071* (2013.01); *A63B 69/00* (2013.01); *A63B 63/00* (2013.01)
USPC ..... 473/433; 473/447; 473/481

(58) Field of Classification Search
CPC ..... A63B 63/00; A63B 63/08; A63B 69/00; A63B 69/0071
USPC ..... 473/432–435, 447–449, 472, 479–489
See application file for complete search history.

(56) References Cited

U.S. PATENT DOCUMENTS

| | | | | | |
|---|---|---|---|---|---|
| 2,889,149 | A * | 6/1959 | Williams | 473/433 |
| 3,388,909 | A * | 6/1968 | Woods | 473/472 |
| 3,901,506 | A * | 8/1975 | Caveney | 473/433 |
| 4,239,214 | A * | 12/1980 | Brenner | 273/342 |
| 4,595,199 | A * | 6/1986 | Offutt | 473/435 |
| 5,299,800 | A * | 4/1994 | Daniels | 473/481 |
| 5,507,483 | A * | 4/1996 | Hektor | 473/433 |
| 5,524,881 | A * | 6/1996 | Edward | 473/447 |
| 5,536,003 | A * | 7/1996 | Brenner | 473/481 |
| 6,267,696 | B1 * | 7/2001 | Mabe et al. | 473/433 |
| 6,929,569 | B1 * | 8/2005 | Wang | 473/433 |
| 7,201,676 | B2 * | 4/2007 | Rumfola, III | 473/447 |
| 7,247,105 | B2 * | 7/2007 | Huntsberger | 473/433 |
| 7,311,617 | B2 * | 12/2007 | Langhorn | 473/446 |
| 2006/0040770 | A1 * | 2/2006 | Chou | 473/433 |

* cited by examiner

*Primary Examiner* — Mitra Aryanpour

(57) ABSTRACT

A game apparatus comprising a mount and a goal can be attached to basketball hoops and serve as a target. This allows a basketball court to be used for an entirely new game using said game apparatus and flying sport discs. The method of playing includes two teams of players, each attempting to score on one target while preventing the opposing team from scoring on a separate target. Players may move with, pass, and shoot the flying sport disc. Points are accumulated for goals scored when the flying sport disc is thrown through a target. The basketball court provides ready markings used for shots, throw-ins, and defining out of bounds in the present game method.

6 Claims, 11 Drawing Sheets

DISC HOOPS GAME AND APPARATUS

The current application claims a priority to the U.S. Provisional Patent application Ser. No. 61/450,787 filed on Mar. 9, 2011.

FIELD OF THE INVENTION

The present invention relates generally to a method for playing a team sport utilizing a flying sport disc and an apparatus for use in said sport.

BACKGROUND OF THE INVENTION

Basketball courts are an ubiquitous sight across America. They are found in parks, arenas, gyms, and schools. Some people even set up basketball hoops at their homes. These basketball courts provide an available resource around which new games can be designed. Though there are many games that use the basketball court, most of those games are played with a ball and are essentially variations of basketball. The present invention provides an apparatus and a method to more completely transform the basketball court for use in a new game. The provided apparatus can be affixed to basketball hoops and serve as a target for a game utilizing flying sport discs rather than basketballs. In this manner, a completely new game with different goals, rules, and equipment can be played on a basketball court. The equipment can also be set up using a lone basketball hoop that many people set up at their homes, allowing variations of the present method to be played.

DETAIL DESCRIPTIONS OF THE INVENTION

Figure 1:
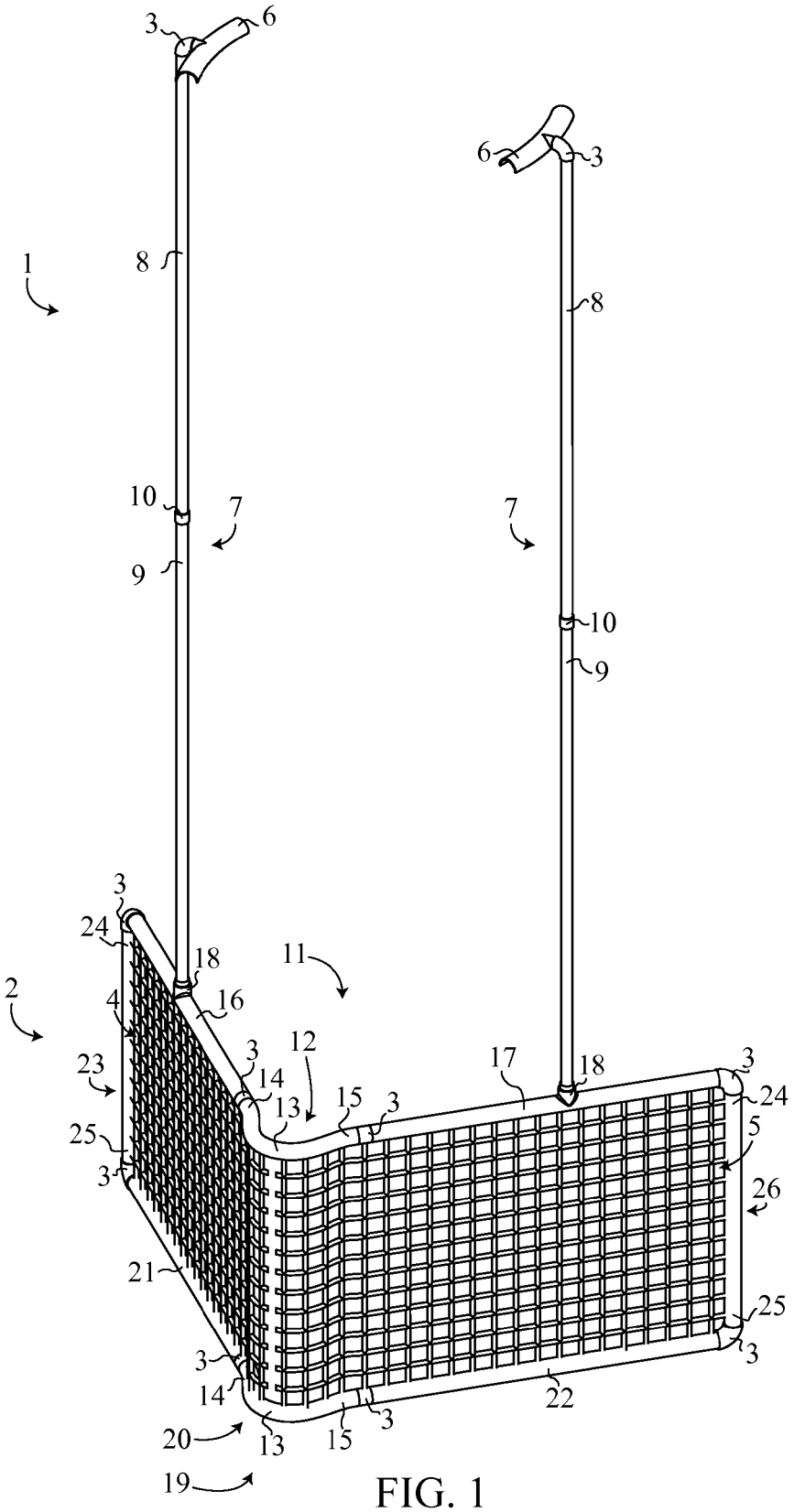
FIG. 1 is a perspective view of the apparatus of the present invention.
Figure 2:
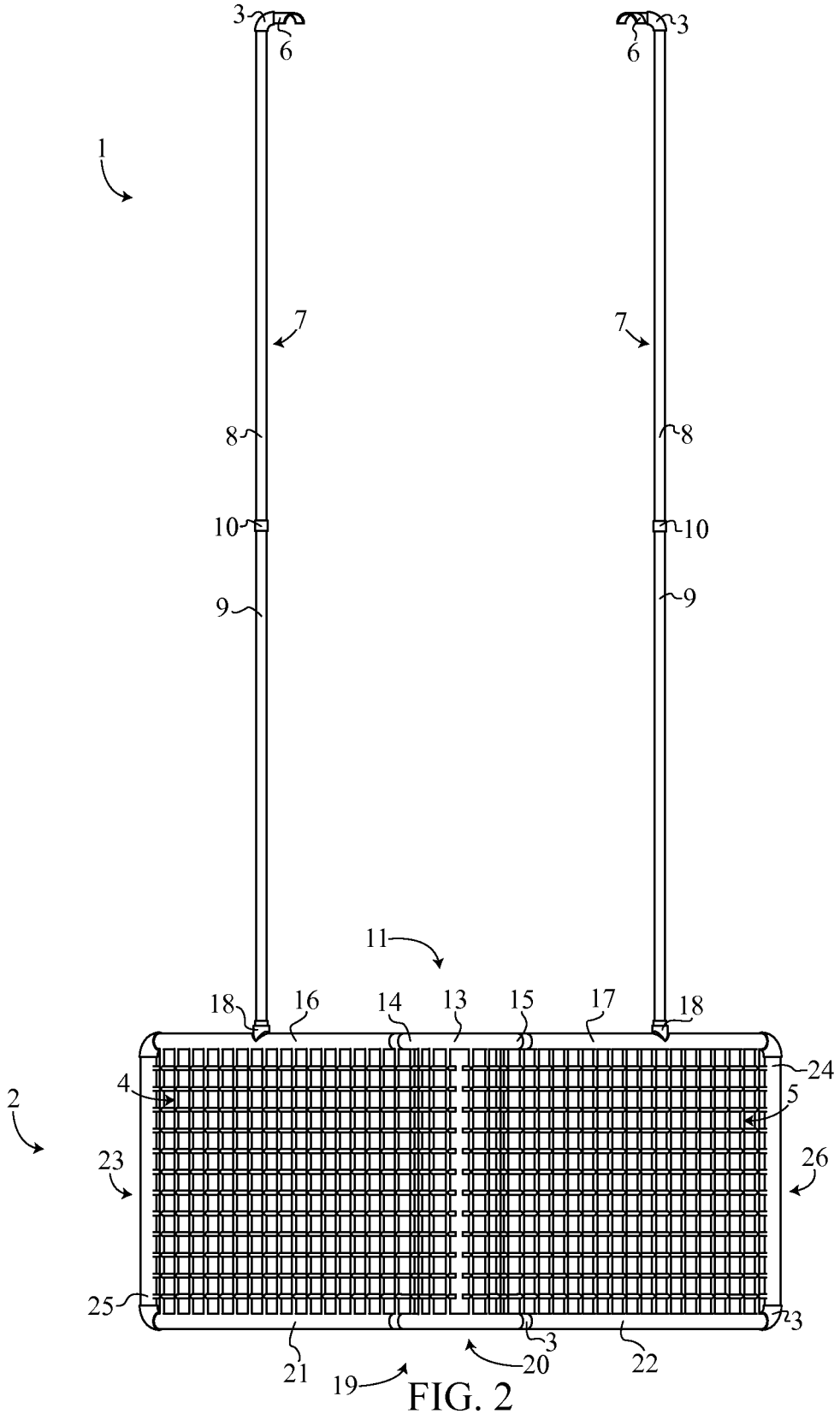
FIG. 2 is a front view of the apparatus of the present invention.
Figure 3:
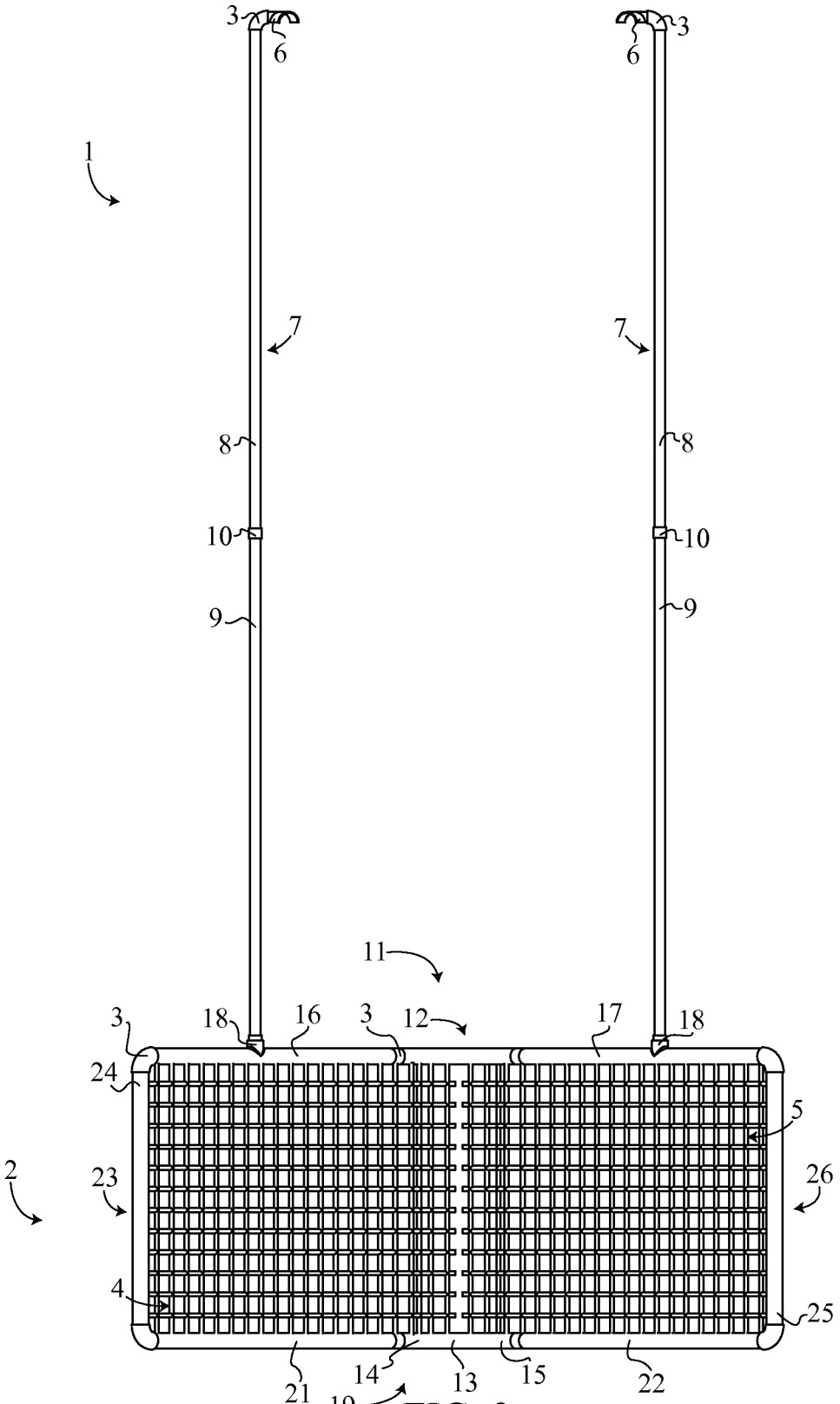
FIG. 3 is a rear view of the apparatus of the present invention.
Figure 4:
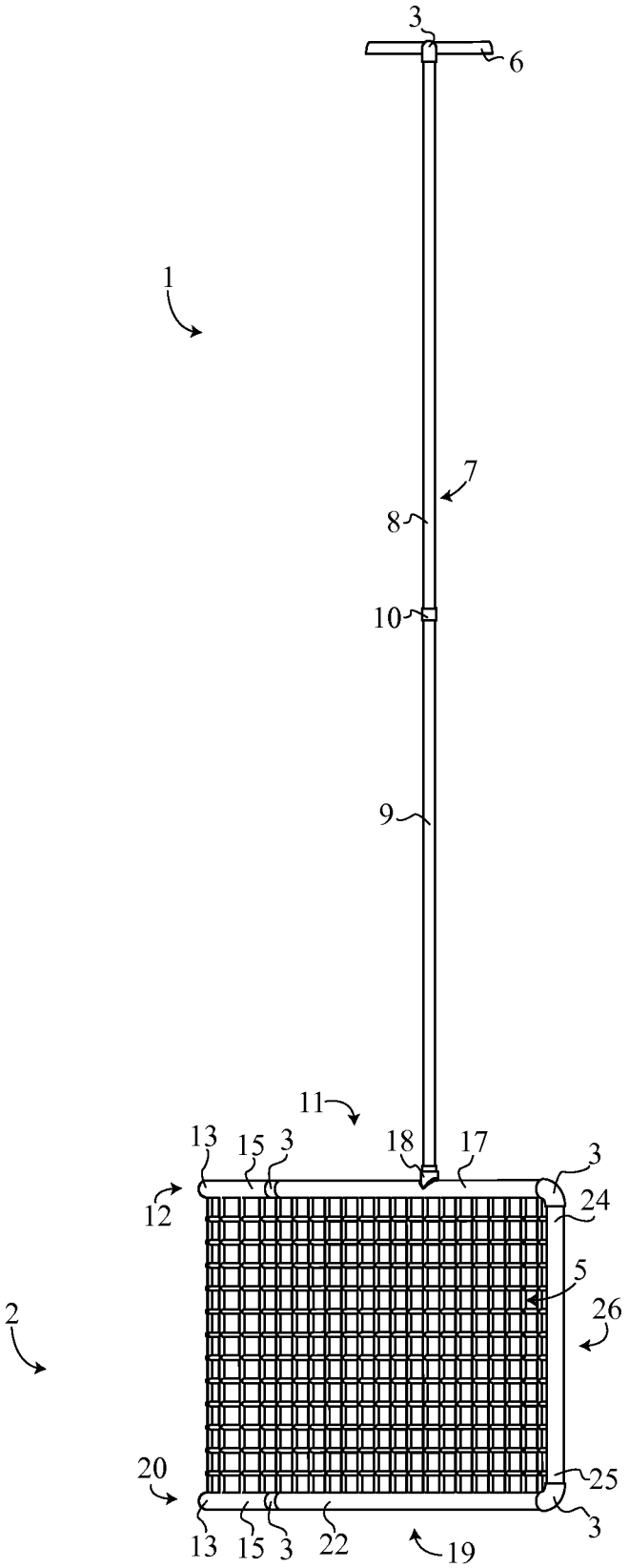
FIG. 4 is a right view of the apparatus of the present invention.
Figure 5:
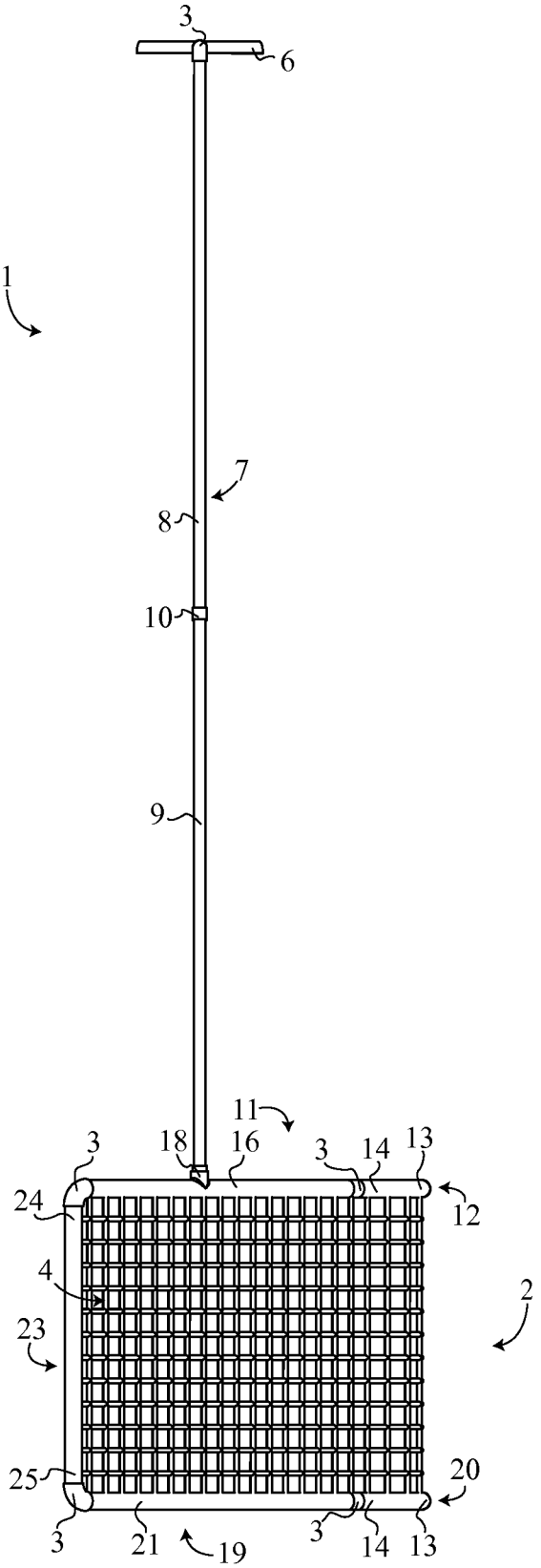
FIG. 5 is a left view of the apparatus of the present invention.
Figure 6:
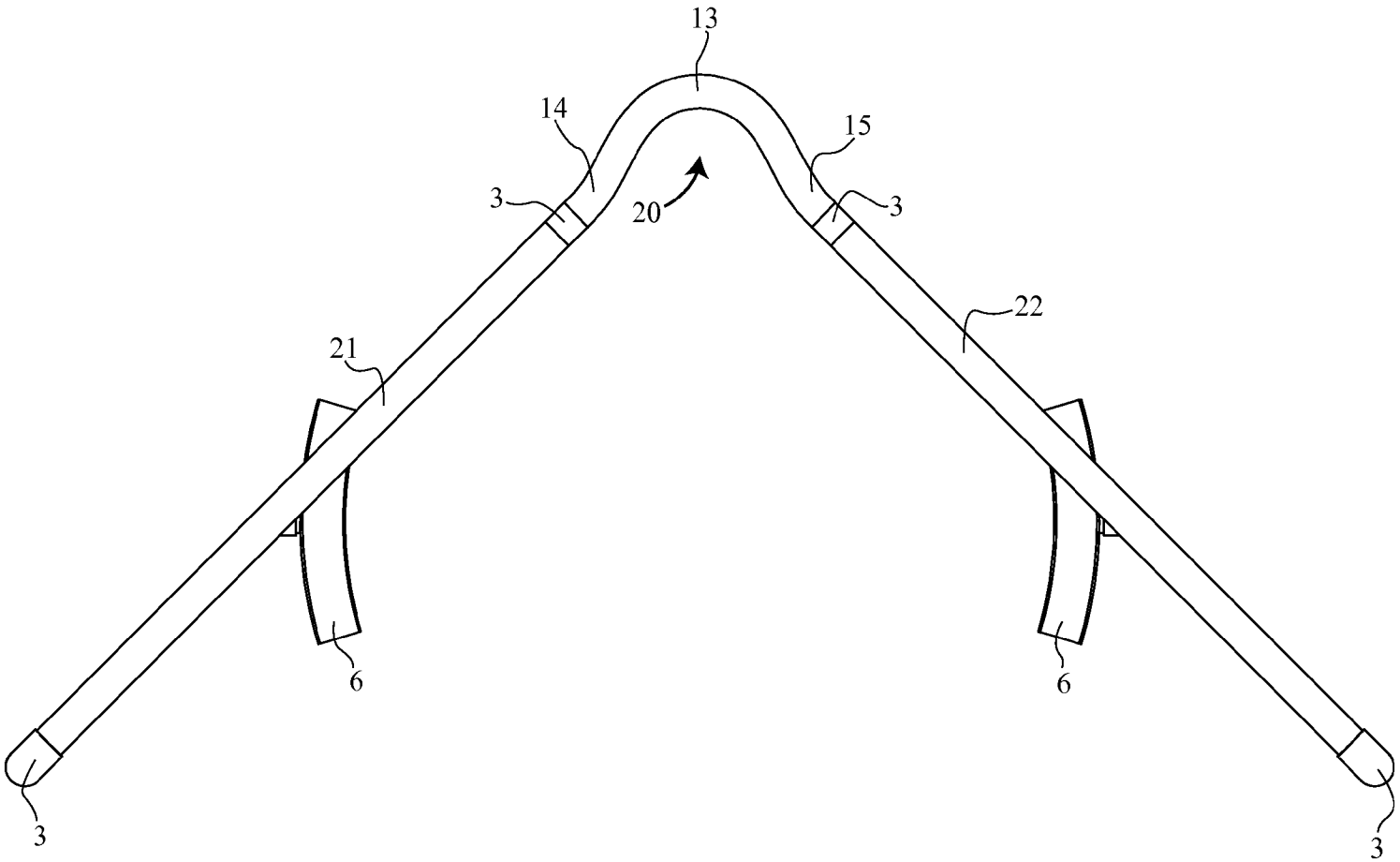
FIG. 6 is a bottom view of the apparatus of the present invention.
Figure 7:
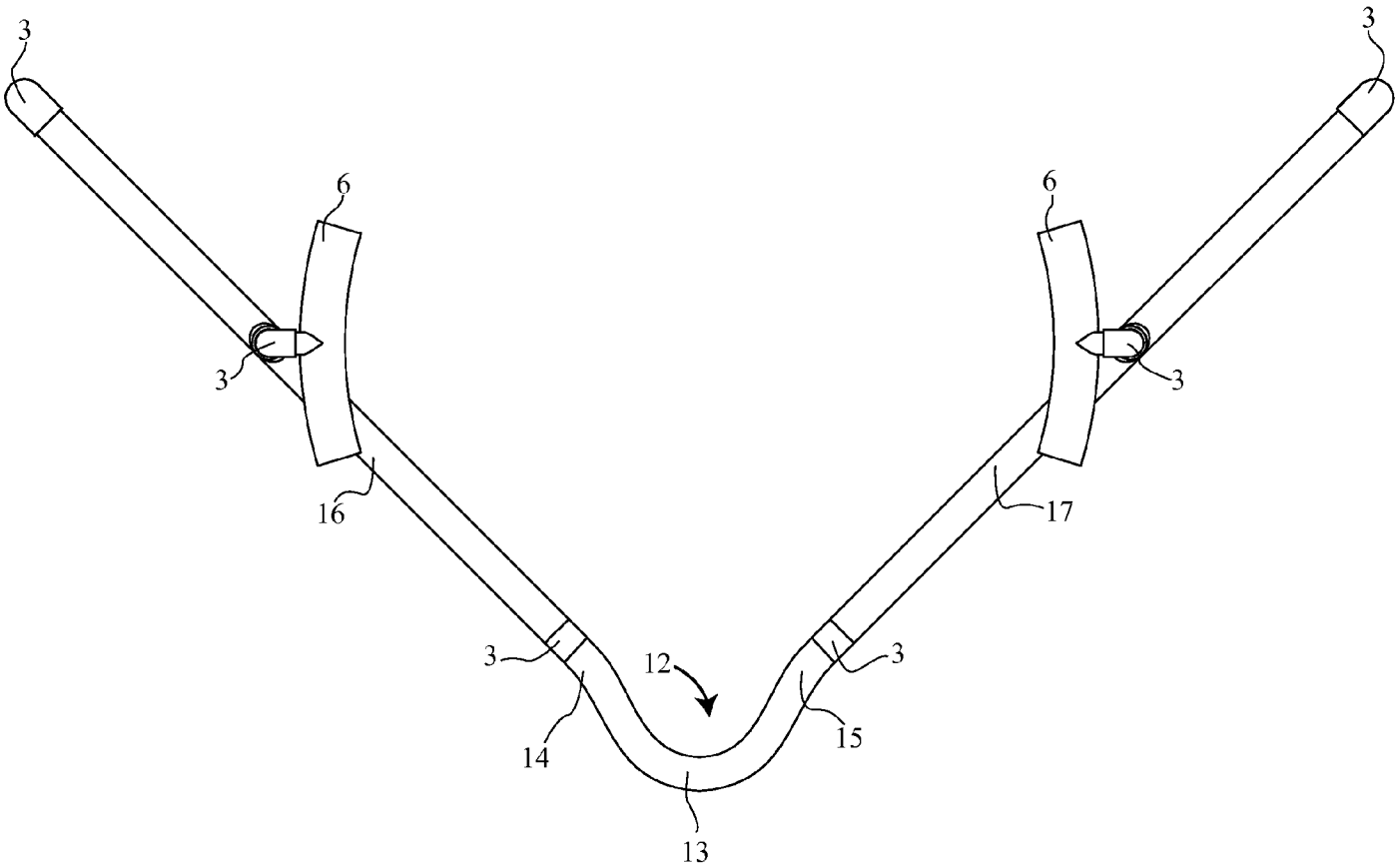
FIG. 7 is a top view of the apparatus of the present invention.
Figure 8:
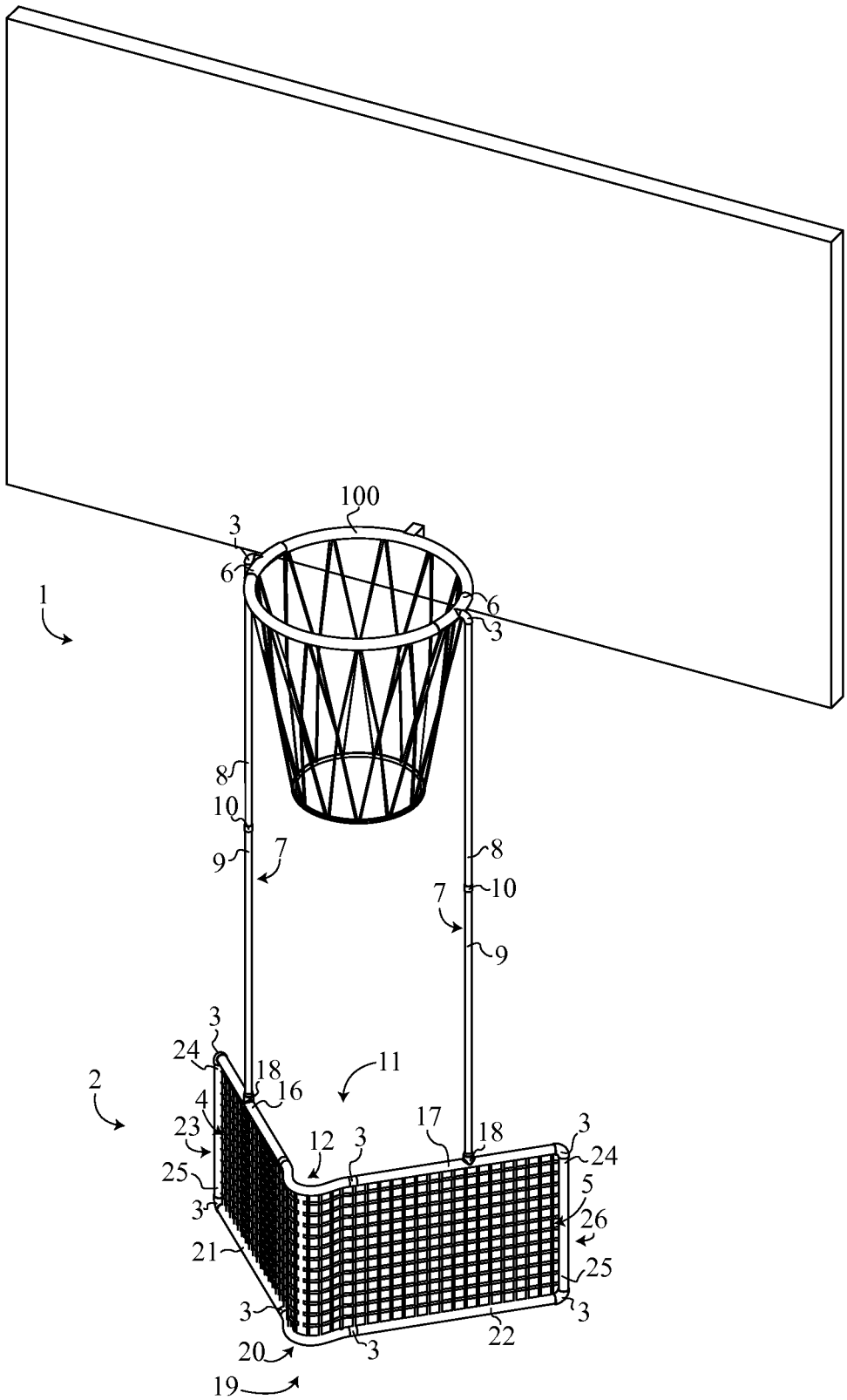
FIG. 8 is a perspective view of the apparatus of the present invention when affixed to a basketball rim.
Figure 9:
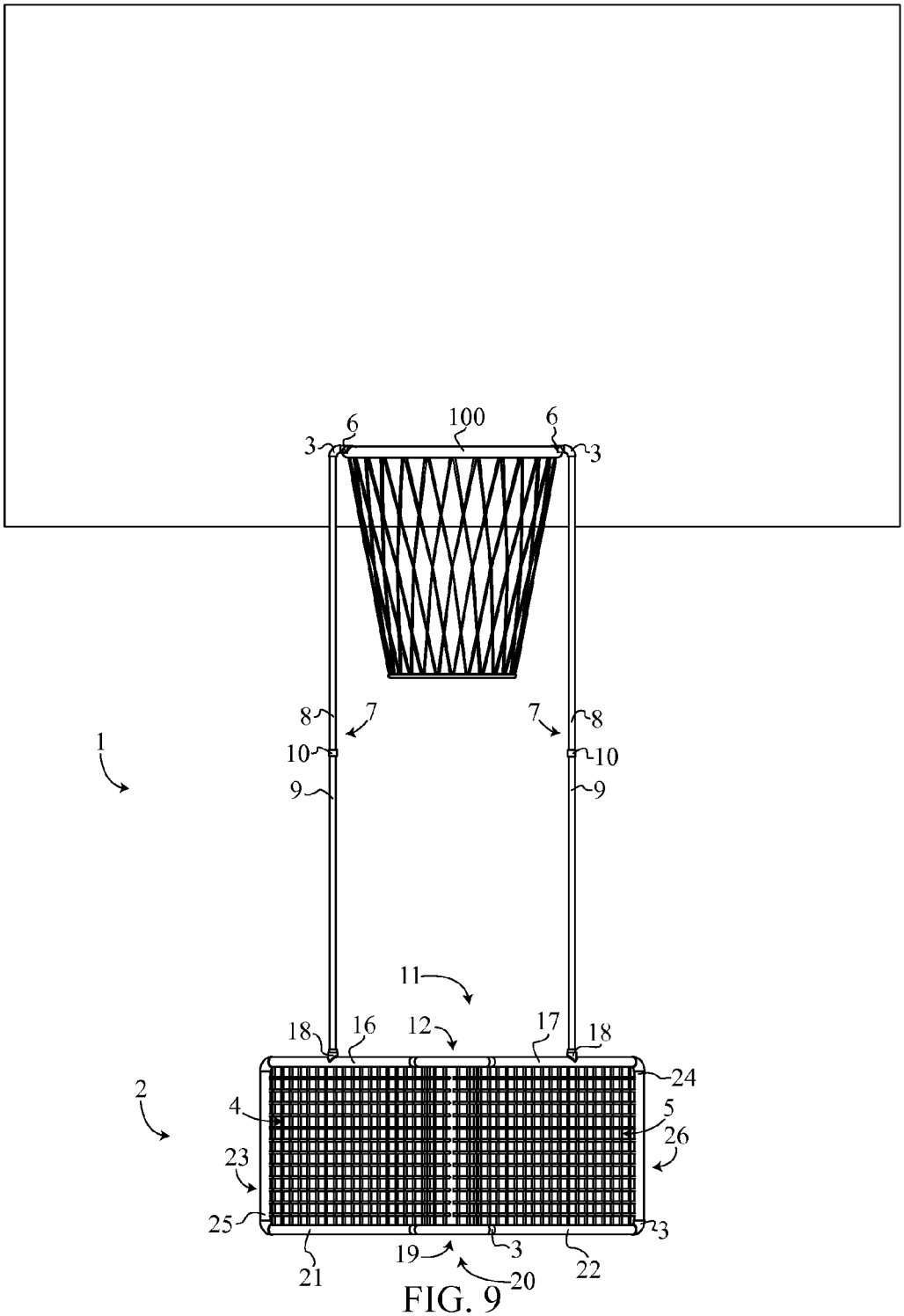
FIG. 9 is a front view of the apparatus of the present invention when affixed to a basketball rim.
Figure 10:
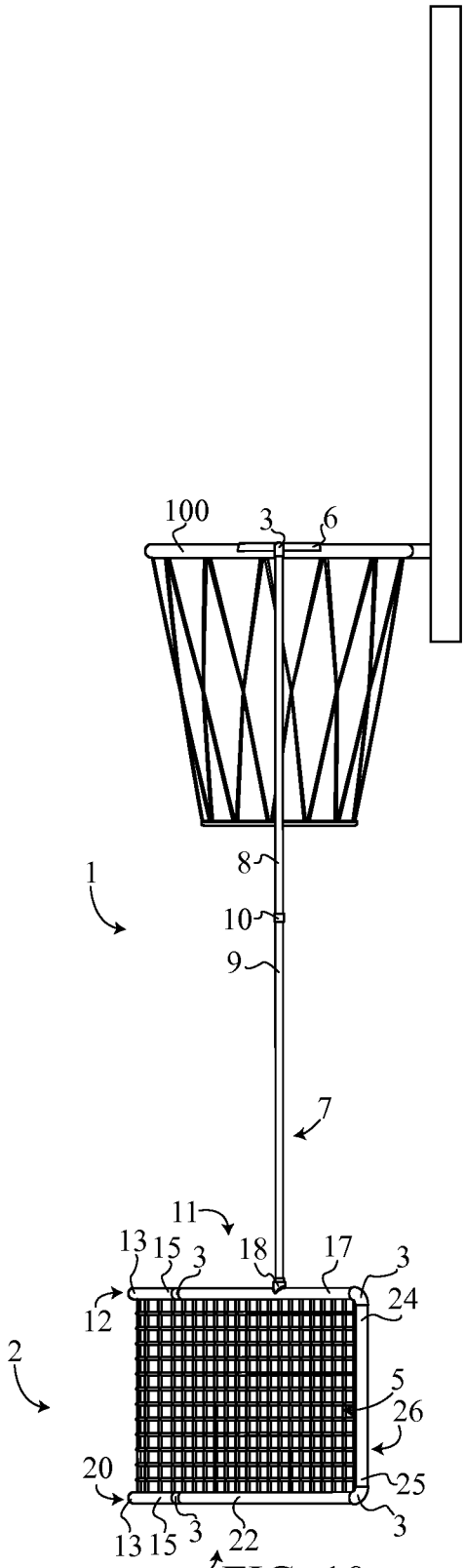
FIG. 10 is a right view of the apparatus of the present invention when affixed to a basketball rim.
Figure 11:
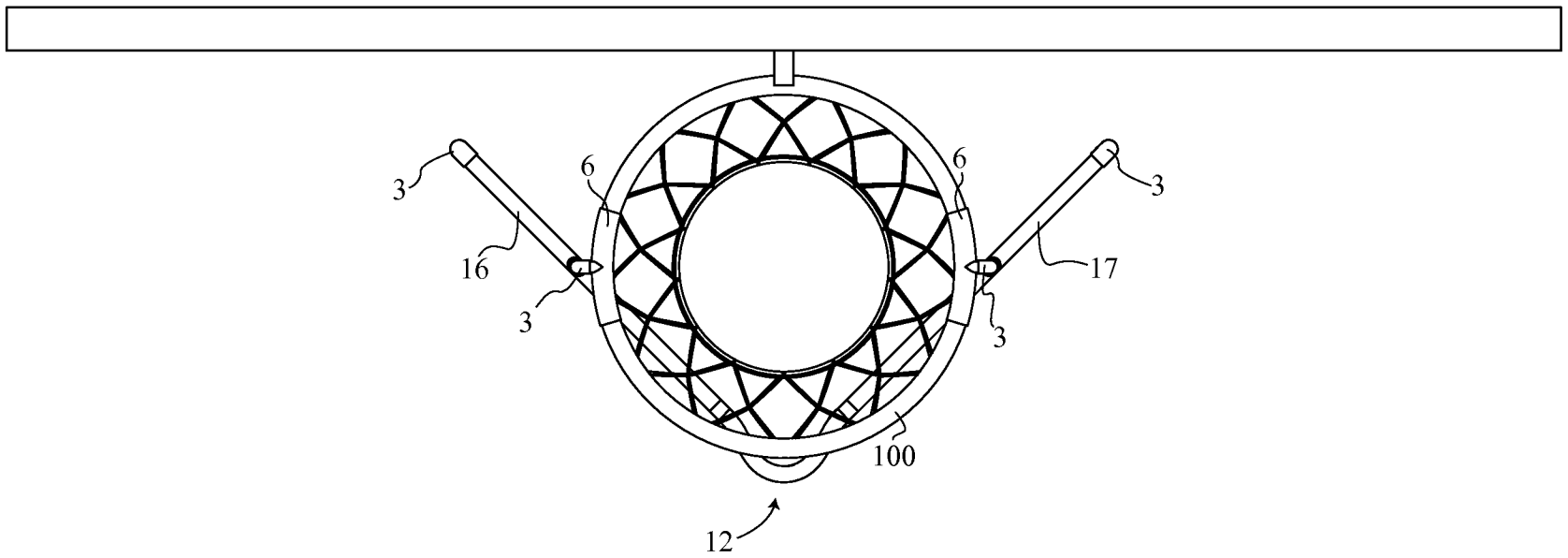
FIG. 11 is a top view of the apparatus of the present invention when affixed to a basketball rim.

All illustrations of the drawings are for the purpose of describing selected versions of the present invention and are not intended to limit the scope of the present invention.

The disc goal hoop is a netted goal designed for use in a game with flying sport discs. The disc goal hoop is designed to interface with a basketball rim 100, allowing a completely new game to be played on a basketball court. The disc goal hoop comprises a mount 1, a goal 2, a plurality of connectors

3, a left net 4, and right net 5. The mount 1 connects to the top of the goal 2. The mount 1 also slides over and hooks onto a basketball rim 100, in effect suspending the goal 2 from a basketball rim 100. The goal 2 serves as a target for sport discs. The left net 4 and right net 5 are attached across the goal 2 and slow down any sport discs that go through the goal 2. The plurality of connectors 3 secure the goal 2 to the mount 1, as well as connecting individual pieces of both the mount 1 and the goal 2.

The mount 1 comprises a plurality of braces 6 and a plurality of extension rods 7. The extension rods 7 further comprise a first section 8, a second section 9, and a tube cuff 10. The braces 6 are designed to lie atop a basketball rim 100. The braces 6 are curved to match the curve of a basketball rim 100. The braces 6 also have an open bottom, which allows the braces 6 to attach to a basketball rim 100 by sliding over and latching onto the basketball rim 100. In the preferred embodiment there are two braces 6, and since a basketball rim 100 is 18 inches in diameter, the hook rods should be spaced 18 inches apart across the basketball rim 100. At each brace there is a connected extension rod 7, perpendicular to the hook rod and secured by a connector 3. To allow the mount 1 to fit over a basketball rim 100, the extension rods 7 must have at least an 18 inch gap between them. The first section 8 and second section 9 are telescopically connected to each other such that the second section 9 may slide into the first section 8. Tube cuffs 10 secure the second section 9 to the first section 8. Since the second section 9 may slide into the first section 8, the overall height of the mount 1 may be adjusted. In the preferred embodiment the first section 8 and second section 9 are each 24 inches in length, such that a fully extended mount 1 will protrude 48 inches below a basketball rim 100. Regulation height of the disc goal hoop will therefore be 6 feet (measured from the top of the goal 2), as a regulation basketball rim 100 is 10 feet in height. If a non regulation basketball rim 100 is used the telescopic extension rods 7 allow the height of the disc goal hoop to be adjusted to regulation height. For example, if a basketball rim 100 9 feet high is used, the extension rods 7 can be adjusted to be 36 inches in height (rather than 48 inches), which would set the disc goal hoop to the regulation height of 6 feet. In the preferred embodiment the hang rod and extension rods 7 are tubular and have a diameter of ½ inch.

The goal 2 comprises a top section 11, a bottom section 19, a left connecting tube 23, and a right connecting tube 26. The top section 11 and bottom section 19 are connected to each other by the left connecting tube 23 and the right connecting tube 26. The top section 11 further comprises a top center tube 12, a top left tube 16, a top right tube 17, and a plurality of T-shaped attachments 18. The top center tube 12 and the bottom center tube 20 each comprise a center 13, a left end 14, and a right end 15. The preferred embodiment will have the following dimensions: a height of 14 inches measured from the top section 11 to the bottom section 19, a width of 34 inches measured from the left connecting tube 23 to the right connecting tube 26, and a depth of 14 inches measured from the plane of the top center tube 12 and bottom center tube 20 to the plane of the left connecting tube 23 and the right connecting tube 26.

The left end 14 and right end 15 of the top center tube 12 lie in the same plane as the center 13 and are angled 45 degrees from a line parallel to the floor of the court and bisecting the disc goal hoops through the center 13 of the top center tube 12. As a result of the left end 14 and right end 15 being angled, the top center tube 12 is V-shaped. The top left tube 16 is aligned and connected to the left end 14 of the top center tube 12, such that the top left tube 16 and left end 14 form a straight line. The top right tube 17 is aligned and connected to the right end 15 in the same manner. Located on and protruding from the top left tube 16 and top right tube 17 are a plurality of T-shaped attachments 18. These T-shaped attachments 18 are perpendicular to the top center tube 12, top left tube 16 and top right tube 17. The extension rods 7 are attached to the T-shaped attachments 18, thus connecting the goal 2 to the extension rods 7. In the preferred embodiment the extension rods 7 are attached to the T-shaped attachments 18 by a threaded connector 3 matching the receptacle of the T-shaped attachments 18. The plurality of connectors 3 connect the top left tube 16 to the left end 14 of the top center tube 12 and attach the top right tube 17 to the right end 15 of the top center tube 12.

The bottom section 19 comprises a bottom center tube 20, a bottom left tube 21, and a bottom right tube 22. The bottom section 19 is arranged identically to the top section 11, minus the T-shaped attachments 18, which are not part of the bottom section 19. Like the top section 11, the bottom center tube 20 has the left end 14 and right end 15 angled 45 degrees from the center 13. The left end 14 of the bottom center tube 20 and the bottom left tube 21 are connected and collinear. Similarly, the right end 15 of the bottom center tube 20 and the bottom right tube 22 are connected and collinear. The plurality of connectors 3 connect the bottom left tube 21 to the left end 14 of the bottom center tube 20 and attach the bottom right tube 22 to the right end 15 of the bottom center tube 20.

The left connecting tube 23 and right connecting tube 26 each comprise a first end 24 and a second end 25. The first end 24 and the second end 25 of the left connecting tube 23 connect the top left tube 16 to the bottom left tube 21, respectively. In the same manner, the first end 24 and the second end 25 of the right connecting tube 26 connect the top right tube 17 to bottom right tube 22. The left connecting tube 23 and the right connecting tube 26 are secured to the top section 11 and the bottom section 19 by the plurality of connectors 3.

The 45 degree angle of the disc goal hoop, mentioned as part of the top section 11 and bottom section 19, provides advantages compared to a target which is only open across one plane, such as a soccer goal. Having the 45 degree angle makes shots from the sides of the court more feasible. A flat target, if shot at from an angle, would have an extremely small cross-section and be much more difficult to hit. Having the 45 degree angle increases the area that must be defended during play. For example, a regular flat target would be almost impossible to hit from its side whereas a player could potentially score on the 45 degree angle disc goal hoop from the sides. The 45 degree angle also allows the disc goal hoop to be properly balanced when suspended from a basketball rim 100.

The net comprises a left net 4 and a right net 5. The left net 4 is attached to the top left tube 16 and the left end 14 of the top center tube 12. The right net 5 is connected to the top right tube 17 and the right end 15 of the top center tube 12. Thus the left net 4 and the right net 5 hang from the top section 11 of the goal 2. This allows the net to function as a breakaway net rather than a catch net. Instead of catching any sport discs that fly into the net, the breakaway net simply parts and slows the sport discs down. The breakaway net serves two purposes. First, goals scored are easier to identify due to the motion of the net as a sport disc passes through. Second, the net creates a swoosh similar to basketball, which adds excitement to the game and further aides in identifying goals scored.

The disc goal hoop is portable and can be easily attached to or removed from any basketball rim 100 through the use of the mount 1. The disc goal hoop is constructed from light weight materials and is easy to move. A single person should be able to lift the disc goal hoop and secure it to a basketball rim 100. The extension rods 7 can be detached from the T-shaped attachments 18. This makes the disc goal hoop easier to store and transport, as each extension rod can be removed from the disc goal hoop and collapsed into a 24 inch length (as the 24 inch first section 8 and second section 9 are telescopically connected). Thus the disc goal hoop can be separated into three pieces: the goal 2 and two extension rods 7, facilitating storage and transportation.

The disc hoops game is generally played between two teams of players, with each team comprising two or more players. The disc hoops game requires two disc goal hoops, a sport disc, and a basketball court. The disc goal hoops are mounted on basketball rims 100, while the basketball court provides markings used during play of the disc hoops game. The relevant markings are the boundary lines, the base lines, the keys, the three point lines, and the half court line. In the preferred embodiment the sport disc is sized at 24 centimeters. Other embodiments can use other types and sizes of discs, such as an ultimate disc.

Once the disc goal hoops have been set up and teams have been formed the game can begin. The object of the game is to be the first team to accumulate 5 points. In other embodiments, a different predefined point value can be used. To start the game the teams determine which team begins with possession of the sports disc. In the preferred embodiment, a coin toss is used to determine which team begins with possession of the sports disc. Alternative methods, such as a rock-paper-scissors can be used. Whatever method is used to determine the opening possession should be quick and simple. Once the opening possession has been decided, the team beginning with possession chooses one disc goal hoop to score on, while the opposing team will attempt to score on the other disc goal hoop. The team with opening possession begins the game by throwing the sport disc into play from the baseline opposite the disc goal hoop said team is trying to score on. The throw-in is performed by passing the sport disc to a player on the same team. If a team fails to perform a throw-in within 10 seconds, the opposing team gains possession of the sport disc and attempts to throw it in from the same location that the first team did. In other embodiments a different time limit may be imposed upon throw-ins.

Game play consists of moving, passing, and shooting the sport disc in an attempt to score on the appropriate disc goal hoop. Players who have possession of the sport disc may move, pass, or shoot the sport disc, with the following restrictions.

While holding the sport disc, a player may take a maximum of two steps in any direction. After two steps have been taken, the player may either move laterally or establish a pivot foot. A player moving laterally may move side-to-side to try and find an open teammate or to get a better shot at the disc goal hoop. A player establishing a pivot foot may pivot about said pivot foot in an attempt to find an open teammate or to get a better shot at the disc goal hoop. In the preferred embodiment a player holding the sport disc (but not performing a throw-in) has 20 seconds to pass or shoot the sport disc. As with throw-ins, other embodiments may set a different time limit for how long the sport disc can be held by a single player. If a player holds on to the disc for longer than 20 seconds, the opposing team is awarded the sport disc at the boundary line or baseline closest to said player. The opposing team then has 20 seconds to pass or shoot the sport disc.

Several markings of the basketball court are used to determine out of bounds areas. The boundary lines and baselines, as well as areas outside of them, are considered out of bounds. If the sport disc or a player with the sport disc goes out of bounds the sport disc is awarded to the opposite team at the boundary line or the baseline where the sport disc or player went out of bounds. They key (henceforth referred to as the "fly zone") is also considered out of bounds. However, a sport disc can pass through the fly zone if attempting a pass or a shot. If the sport disc lands in the fly zone, it is considered out of bounds and follows the same rules as above. If any player (including those without the sport disc) step on the key they cause a violation. A violation results in the opposing team being awarded one point.

Players are not allowed to intentionally physically contact each other. However, movement and positioning can be used to defend passes and shots, similar to offensive screens in basketball.

Players score a goal for their team by throwing the sport disc through the appropriate disc goal hoop. A team is awarded one point for scoring a goal. If the goal is scored from beyond the three point line, the team is awarded a bonus point, for a total of 2 points. In alternative embodiments different point values can be assigned to shots, just as the point total to win (5 points in the preferred embodiment) can be varied.

Alternative rules can replace or be added to the above rules to vary the game. For example, a shot clock can be added; in the preferred embodiment this would be 60 seconds and if a team failed to shoot in that time period the opposing team would be given possession of the sport disc at the baseline of the disc goal hoop they are defending.

A time limit can be used instead of having a set point total to win; the team with the most points at the end of the set time would win. In the event of a tie, the next team to score a goal would win.

Other variations include half court games or accuracy games. Half court games would only require half a basketball court and a single disc goal hoop. For every change of possession a team would need to bring the sport disc back to the half court line before attempting a shot. Accuracy games can also be played using the disc goal hoop. An example of an accuracy game is "horse", perhaps renamed "disc", wherein a players would alternate taking shots as a disc goal hoop. If a player makes a shot, other players would have to replicate the shot (shoot from the same position and hit the disc goal hoop). Failing to do so would result in receiving an "h". Every time a player misses a shot that a first player made, the player would be given another letter from the word horse; if a player has all the letter from horse, they are eliminated. The last player remaining is the winner. This is just one example of an accuracy game that can be played using the disc goal hoops.

Although the invention has been explained in relation to its preferred embodiment, it is to be understood that many other possible modifications and variations can be made without departing from the spirit and scope of the invention as hereinafter claimed.

What is claimed is:

1. A disc goal hoop comprises:

a mount;

a goal a plurality of connectors;

a left net;

a right net;

the mount comprises a plurality of braces and a plurality of extension rods;

the goal comprises a top section, a bottom section, a left connecting tube, and a right connecting tube;

the plurality of extension rods comprises a first section, a second section, and a tube cuff;

the top section comprises a top center tube, a top left tube, a top right tube, and a plurality of T-shaped attachments;

the bottom section comprises a bottom center tube, a bottom left tube, and a bottom right tube;

the plurality of extension rods being attached to the plurality of T-shaped attachments;

the left connecting tube and the right connecting tube each comprise a first end and a second end;

the first end of the left connecting tube being perpendicularly connected to the top left tube;

the second end of the left connecting tube being perpendicularly connected to the bottom left tube;

the plurality of connectors securing the first end of the left connecting tube to the top left tube and securing the second end of the left connecting tube to the bottom left tube;

the first end of the right connecting tube being perpendicularly connected to the top right tube;

the second end of the right connecting tube being perpendicularly connected to the bottom right tube;

the plurality of connectors securing the first end of the right connecting tube to the top right tube and securing the second end of the right connecting tube to the bottom right tube;

the left connecting tube being parallel to the right connecting tube;

the left net being connected to the top left tube and the left end of the top center tube;

the right net being connected to the top right tube and the right end of the top center tube;

the second section traversing into the first section;

the tube cuff connecting the first section and the second section;

the plurality of extension rods being perpendicularly connected to the plurality of braces;

the plurality of connectors securing the plurality of extension rods to the plurality of braces;

the plurality of extension rods being spaced 18 inches apart from each other, wherein the plurality of braces rest upon a rim of a regulation sized basketball hoop;

the plurality of braces being positioned atop on said rim;

the plurality of braces being curved to match a curve of said rim; and the plurality of braces having an open bottom.

2. The disc goal hoop as claimed in claim 1 comprises, the top center tube and the bottom center tube each comprise a center, a left end, and a right end;

the left end and the right end being symmetrically angled from the center;

the top left tube being collinearly connected to the left end of the top center tube;

the top right tube being collinearly connected to the right end of the top center tube;

the plurality of connectors securing the top center tube to the top left tube and the top right tube;

the bottom left tube being collinearly connected to the left end of the bottom center tube;

the bottom right tube being collinearly connected to the right end of the bottom center tube;

the plurality of connectors securing the bottom center tube to the bottom left tube and the bottom right tube; and the plurality of T-shaped attachments being located on the top left tube and the top right tube.

3. The disc goal hoop as claimed in claim 2 comprises, the plurality of T-shaped attachments being perpendicular to the top left tube and the top right tube.

4. A disc goal hoop comprises:
a mount;
a goal
a plurality of connectors;
a left net;
a right net;
the mount comprises a plurality of braces and a plurality of extension rods;
the goal comprises a top section, a bottom section, a left connecting tube, and a right connecting tube;
the plurality of extension rods comprises a first section, a second section, and a tube cuff;
the top section comprises a top center tube, a top left tube, a top right tube, and a plurality of T-shaped attachments;
the bottom section comprises a bottom center tube, a bottom left tube, and a bottom right tube;
the plurality of extension rods being attached to the plurality of T-shaped attachments;
the second section traversing into the first section;
the plurality of extension rods being perpendicularly connected to the plurality of braces;
the top center tube and the bottom center tube each comprise a center, a left end, and a right end;
the left end and the right end being symmetrically angled from the center;
the top left tube being collinearly connected to the left end of the top center tube;
the top right tube being collinearly connected to the right end of the top center tube;
the bottom left tube being collinearly connected to the left end of the bottom center tube;
the bottom right tube being collinearly connected to the right end of the bottom center tube;
the left connecting tube and the right connecting tube each comprise a first end and a second end;
the first end of the left connecting tube being perpendicularly connected to the top left tube;
the second end of the left connecting tube being perpendicularly connected to the bottom left tube;
the first end of the right connecting tube being perpendicularly connected to the top right tube;
the second end of the right connecting tube being perpendicularly connected to the bottom right tube;
the tube cuff connecting the first section and the second section;
the plurality of connectors securing the plurality of extension rods to the plurality of braces;
the plurality of extension rods being spaced 18 inches apart from each other, wherein the plurality of braces rest upon a rim of a regulation sized basketball hoop;
the plurality of braces being positioned atop on said rim;
the plurality of braces being curved to match a curve of said rim;
the plurality of braces having an open bottom;
the plurality of connectors securing the top center tube to the top left tube and the top right tube;
the plurality of connectors securing the bottom center tube to the bottom left tube and the bottom right tube;
the plurality of T-shaped attachments being located on the top left tube and the top right tube; and
the plurality of T-shaped attachments being perpendicular to the top left tube and the top right tube.

5. The disc goal hoop as claimed in claim 4 comprises,
the plurality of connectors securing the first end of the left connecting tube to the top left tube and securing the second end of the left connecting tube to the bottom left tube;
the plurality of connectors securing the first end of the right connecting tube to the top right tube and securing the second end of the right connecting tube to the bottom right tube; and
the left connecting tube being parallel to the right connecting tube.

6. The disc goal hoop as claimed in claim 4 comprises,
the left net being connected to the top left tube and the left end of the top center tube; and
the right net being connected to the top right tube and the right end of the top center tube.

* * * * *